United States Patent [19]

McDonough

[11] Patent Number: 4,457,090

[45] Date of Patent: Jul. 3, 1984

[54] MODULAR WHEEL SUPPORTED BILLBOARD PANELS WITH LOCKING WEDGES

[76] Inventor: Paul F. McDonough, 159 Warren Ave., Milton, Mass. 02187

[21] Appl. No.: 303,142

[22] Filed: Sep. 17, 1981

[51] Int. Cl.[3] ..... G09F 15/00

[52] U.S. Cl. ..... 40/624; 49/411; 211/175; 211/162; 211/46; 40/605

[58] Field of Search ..... 40/601, 605, 606, 608, 40/624; 49/411; 211/46, 162, 175

[56] References Cited

U.S. PATENT DOCUMENTS

| | | | |
|---|---|---|---|
| 259,716 | 6/1882 | Prescott | 49/411 |
| 1,754,932 | 4/1930 | Browne et al. | 40/624 |
| 1,841,620 | 1/1932 | McCoy | 211/46 |
| 3,120,069 | 4/1958 | Pfaff, Jr. et al. | 40/125 |
| 3,150,455 | 9/1964 | Indorf | 40/125 |
| 3,360,136 | 12/1967 | Ain | 211/162 |
| 3,373,517 | 3/1968 | Halperin | 40/624 |
| 3,634,960 | 1/1972 | Carlos | 40/125 |
| 3,636,669 | 1/1972 | Atkisson | 40/125 |
| 3,732,633 | 5/1973 | Margolis et al. | 211/46 |
| 3,750,893 | 8/1973 | Kempler | 211/162 |
| 3,883,004 | 5/1975 | Slaga | 211/175 |
| 3,888,029 | 6/1975 | Schubert | 40/603 |
| 3,928,929 | 12/1975 | Forte | 40/624 |
| 4,000,573 | 1/1977 | Cohen | 40/142 |

*Primary Examiner*—Gene Mancene
*Assistant Examiner*—James Hakomaki

[57] ABSTRACT

An incremental sheet advertising sign assembly includes a plurality of substantially identical panels to be mounted on a rail frame. Grooved wheels are attached to the back of each panel in such a manner as to engage the uppermost rail of said frame. At least one locking track is mounted vertically along the back surface of each panel, and locking elements slide along the tracks and lock the panel to a lower rail of the rail frame.

11 Claims, 4 Drawing Figures

FIG 1
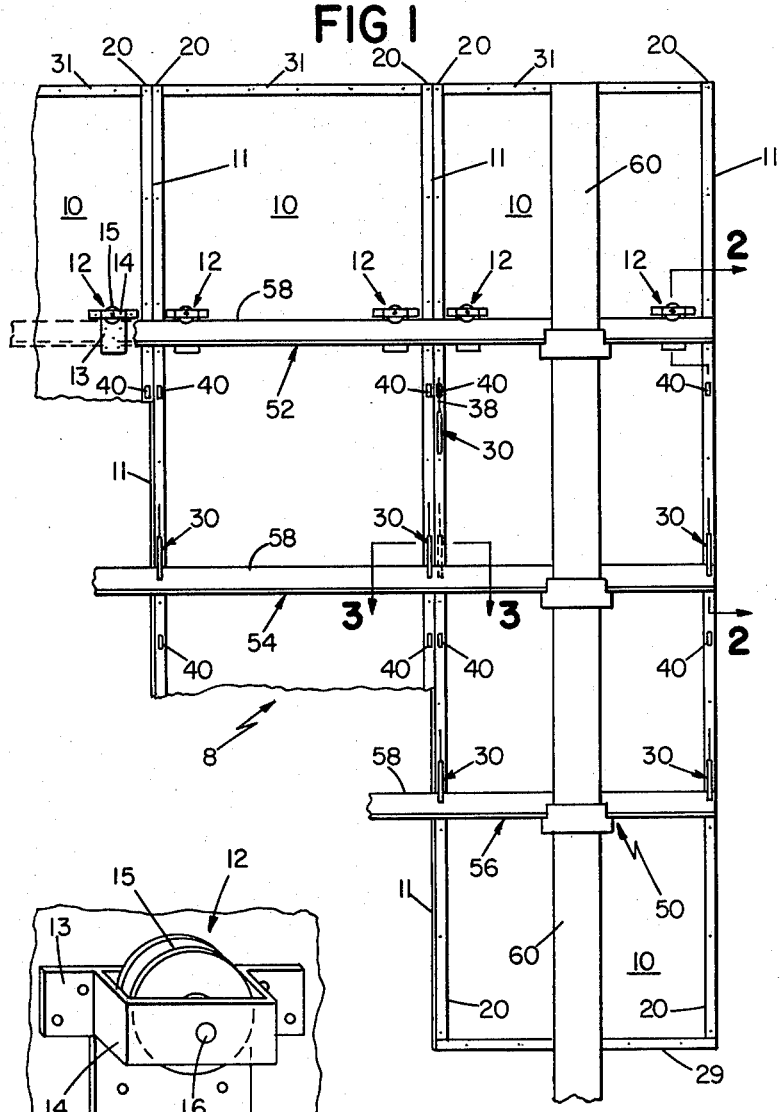
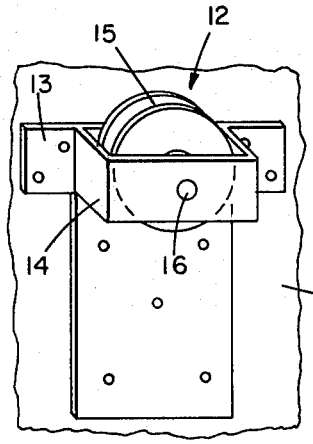
FIG 4
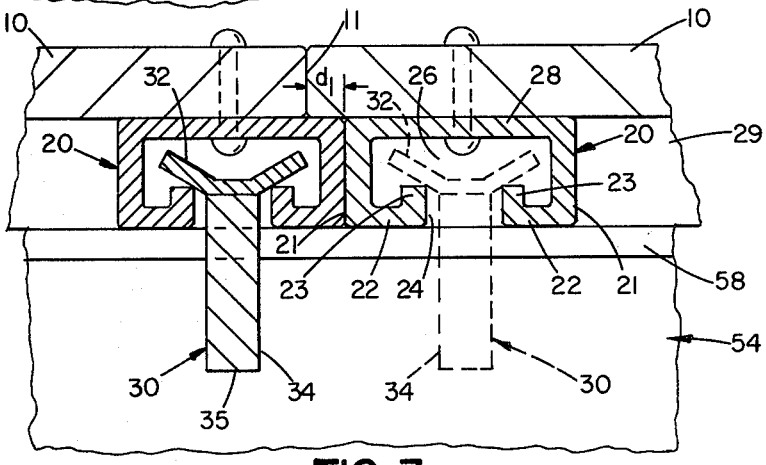
FIG 3
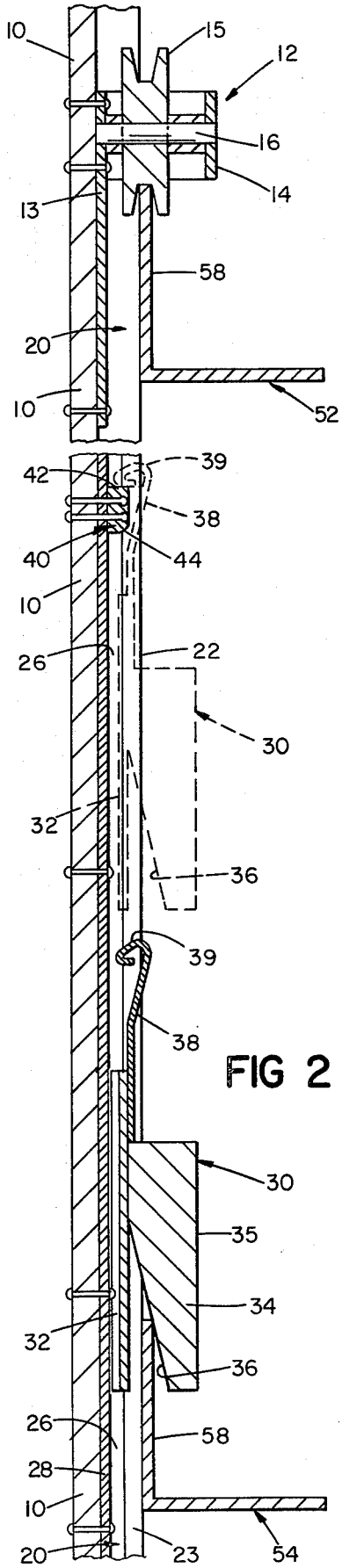
FIG 2

MODULAR WHEEL SUPPORTED BILLBOARD PANELS WITH LOCKING WEDGES

BACKGROUND OF THE INVENTION

This invention relates to advertising sign assemblies.

Advertising signs are often constructed out of a number of individual panels, typically 14"×4'. Usually panels are combined in multiples of ten to fourteen to form a full-sized billboard, which is suspended on a frame composed of horizontal rails attached to one or more vertical posts.

The panels which form the billboard design surface are normally hung to form the desired advertisement size at a base studio where graphic painting (logo, etc.) is completed. They thereupon are dismantled, trucked to a field location and erected.

Once in the field, the panels are moved from location to location until their geographic and temporal impact has been exhausted. They then return to the base studio, a new graphic painting is applied, and the cycle is repeated with another advertising message.

Installation and dismantling of a billboard in the field is generally quite difficult because of the height at which billboards are displayed and the size and weight of the panels themselves. Additionally, although the frames upon which the signs are suspended may be uniform in that they are usually composed of rails having upstanding flanges facing the back surface of the panel, the frames are rarely uniform in the distance between each individual rail.

Prior art assemblies which have been designed for quick and efficient assembling and dismantling (such as those shown in U.S. Pat. Nos. 3,634,980 or 3,120,069) have not been flexible in the type of frame to which the panels could be attached. On the other hand, panel assemblies which have been designed to accommodate any style of rail frame (such as the assembly shown in U.S. Pat. No. 3,150,455) usually employ such a large number of individual clamps or other locking hardware that assembling or dismantling is difficult and time consuming.

SUMMARY OF THE INVENTION

I have found an improved technique for quickly and efficiently installing advertising billboards onto, and subsequently dismantling them from, rail frames of differing designs. My invention features a sign assembly consisting of panels having supports permanently attached to the back of each panel which engage an upper rail of the frame and also act as hoists when pulling the panel up onto the frame and onto the upper rail for proper alignment with the other panels on the rail frame; and, below the supports, a series of locking elements which are slidably disposed within tracks running up the back of the panel.

In preferred embodiments, the support includes a V-grooved wheel and the locking elements are mounted within tracks that run vertically down both sides of the rear of the panel.

My invention has the advantages of having improved assembly and dismantling convenience, low cost (less hardware is required), dual function (support and locking) and great flexibility to accommodate non-uniform rail frame designs.

Other advantages and features of the invention will be apparent from the following description of the preferred embodiments thereof, and from the claims.

DESCRIPTION OF THE PREFERRED EMBODIMENT

FIG. 1 is a rear elevational view of a portion of the sign assembly embodying the invention.

FIG. 2 is a sectional view of a portion of the sign assembly of FIG. 1, taken along the line 2—2 of FIG. 1.

FIG. 3 is a sectional view taken along the line 3—3 of FIG. 1.

FIG. 4 is a perspective view of the support of FIG. 2.

STRUCTURE

An advertising sign arrangement 8 is illustrated in FIG. 1. The display surface of the sign is provided on the front side of sign arrangement 8, which is made up of several panels 10 suspended on a frame 50 composed of horizontal rails 52, 54, 56, each attached to vertical posts 60 and having an upstanding flange 58 which faces the back surface of panel 10. Panel 10 is reinforced on the back by tracks 20 welded or otherwise rigidly secured to each panel 10 near the vertical edges 11 of panel 10.

In this illustrated embodiment, as shown in FIG. 3, each panel 10 has one track 20 secured near an edge 12 such that the track's outer wall 21 is located a given distance $d_1$, away in from edge 11, while another track 20 is secured to the panel's other edge 11 such that its outer wall 21 extends beyond edge 11 the same distance $d_1$. It is immaterial whether wall 21 extends beyond the left or right edge 11 of panel 10, but once a particular orientation is chosen, track placement is uniform along the edges 11 of all of the panels 10 which constitute arrangement 8.

Referring again to FIG. 3, each track 20 is a slotted channel, generally rectangular in transverse cross-section with inwardly directed flanges 22 along both sides 21 defining a slot 24 about one-third the width of the channel. As shown in FIG. 3, a second flange 23 extends inwardly from flanges 22 along each edge of slot 24, thus providing each side 21 of the channel with a generally J-shaped cross-section. Slot 24 between flanges 23 extends the entire length of track 20, and, in conjunction with sides 21 and wall 28 opposite slot 24, defines an elongated recess 26 with the channel.

The back wall 28 of the channel opposite slot 24 is secured to the back side of panel 10 by, for example, spot welds or pop rivets.

In addition to reinforcing panels 10, tracks 20 also carry locking elements 30, with which the panels may be locked to frame 50. Track 20 is open at the top but closed at the bottom by a transverse stiffener 29 which both prevents locking elements 30 from falling out of track 20 and provides panel rigidity. An upper stiffener 31 extends between tracks 20 at the top of each panel.

Referring to FIG. 2 as well as FIG. 3, each locking element 30 has an inner, inwardly arched slide 32 disposed within recess 26 and an outer, downward facing wedge 34 fixed by any conventional method to inner slide 32 and extending from slide 32 outwardly through slot 24. Slide 32 is an open "V", wider in cross-section than slot 24 and sized to be fairly slidable in recess 26, while outer wedge 34 is a block, narrower in cross-section than opening 24 and extending through slot 24 beyond the surface of track 20 so that it may engage the rail frame. As shown, wedge 34 is generally rectangular in cross-section, having a rear surface 35 parallel to track 20 and a forward wedging surface 36 tapering from slide 32 outwardly towards the bottom edge of outer surface 35.

A resilient clip 38 is attached to inner member 32 and extends upward into recess 26, with an inwardly extending hook 39. Situated above each clip 38 of locking element 30 within recess 26 is a block 40 fixed to channel wall 28. Block 40 is generally rectangular in cross-section with an upper face 42 in a plane perpendicular to wall 28, and an outer face 44 contiguous with upper face 42 which curves inwardly at its lower end to meet wall 28.

Referring again to FIG. 1, at least one locking element 30 is provided within recess 26 of each track 20. In the illustrated embodiment, one locking element 30 is provided for each rail in frame 50 except rail 52, the uppermost rail, i.e. there are locking elements 30 in each track 20 for each rail 54, 56.

For engaging upper rail 52, two support devices 12 are fixed to the upper portion of panel 10 along a horizontal line. Referring to FIGS. 2 and 4, each support 12 includes a T-shaped body 13 attached to panel 10, and a box frame 14 in which a wheel 15 is mounted on a shaft 16, the axis of which is perpendicular to panel 10. As shown, frame 14 is deeper and shaft 16 longer than the width of wheel 15, and wheel 15 may slide on shaft 16 within box frame 14 a short distance towards and away from panel 10. In the illustrated embodiment, wheel 15 is a deep-V-groove pulley.

OPERATION

Locking elements 30 slide freely within tracks 20. To assemble the billboard, each locking element 30 is first locked in place within its track by moving it upward until its resilient clip 38 snaps over block 40 and the curved upper hook 39 of the clip 38 engages block upper face 42 and prevents the locking element from sliding down in the track. In this position each locking element 30 is in a position in track 20 which is substantially higher than the rail 54 or 56 of frame 50 which it will engage after panel 10 is hoisted onto frame 50.

Panel 10 is then hoisted onto frame 50 using support 12, and the grooves of pulley wheel 15 are fitted over upstanding flange 58 of uppermost rail 52, thereby supporting panel 10 on frame 50.

Panel 10 may then be rolled along rail 52 into proper alignment with the other panels 10 which constitute the billboard surface. As can be seen in FIG. 3, the vertical edge 11 of one panel 10 will overlap a portion of track 20 of its neighboring panel 10, thus adding to the stability of sign assembly 8.

When a panel 10 is properly positioned, it is locked to frame 50 by releasing resilient clips 38 from blocks 40 and allowing elements 30 to slide downwardly in tracks 20 until the wedging surface 36 of each (which in conjunction with the rear surface of track 20 forms a narrow, downwardly-facing "V") engages one of rails 54, 56, holding the panel tightly against the rails.

Dismantling is effectuated by sliding elements 30 away from contact with rails 54, 56 until their resilient clips 38 snap over the upper faces 42 of respective blocks 40. The panel 10 is then hoisted off rail 52 by means of supports 12.

What is claimed is:

1. An advertising sign assembly comprising a plurality of panels adapted to be mounted on a generally vertical frame that includes at least two vertically-spaced elongated horizontal rails and to be positioned in edgewise abutment with each other to form a planar front advertising surface, each of said panels comprising:

a pair of horizontally-spaced supports fixedly attached to an upper portion of the back surface of said panel, each of said supports including a grooved member adapted to engage an upper one of said horizontal rails when said panel is mounted on said frame;

at least one locking element track attached to the back surface of and extending generally vertically of said panel;

at least one locking element mounted on said track for sliding movement therealong between a first position spaced above a lower one of said rails towards and into a second position in which said locking element engages said lower one of said rails, said locking element including a first portion defining a rearwardly-facing engagement surface extending generally longitudinally of said track and slidingly engaging a longitudinally-extending forwardly-facing surface defined by said track and, a second portion fixed relative to and extending rearwardly from said first portion, said second portion defining an inclined locking surface spaced rearwardly from said track and facing generally towards the back surface of said panel, and being adapted to hook over and engage a lower one of said horizontal rails when said panel is mounted on said frame with said supports engaging said upper one of said horizontal rails and said locking element is slid relative to said track from said first position towards and into engagement with said lower one of said horizontal rails; and means for releasably securing said locking element in said first position when said panel is being placed onto said frame and for permitting said locking element to be slid into said second position when said panel is mounted on said frame with said supports engaging said upper one of said horizontal rails.

2. The assembly of claim 1, wherein each of said panels includes two of said tracks.

3. The assembly of claim 2, wherein said tracks are located near and are generally parallel to the side edges of said panel.

4. The assembly of claim 3 wherein one of said tracks of each of said panels extends beyond the adjacent side edge thereof and the other of said tracks of each of said panels is spaced inwardly from the adjacent side edge thereof, whereby the said one track of a panel will overlap and engage an adjacent said panel when the panels of said assembly are positioned on said frame in said edgewise abutement with each other.

5. The assembly of claim 4, wherein said one track extends beyond the side edge adjacent thereto a distance substantially equal to the distance said other track is spaced inwardly of the side edge adjacent thereto.

6. The assembly of claim 1 wherein each said track includes an elongated recess having a slot along the side thereof facing away from said panel, said first portion of said locking element is mounted within said recess and engages longitudinally extending portions of said track on opposite sides of said slot, and said second portion of said locking element extends rearwardly through said slot.

7. The assembly of claim 6 wherein said first portion includes a slide extending longitudinally of said track and slidable within said recess, said slide having a pair of spaced inclined track engagement surfaces defining, in cross-section transverse to said track, an open "V" wider than said slot, each of said track engagement surfaces engaging a portion of said track on one of the opposite sides of said slot.

8. The assembly in claim 1, including a closure covering the lower end of each said track and adapted to prevent locking elements from falling out the bottoms of said tracks.

9. The assembly of claim 1 wherein said second portion defines, in conjunction with said track, a downwardly-facing "V" shape, the portion of said "V" defined by said track being arranged to engage a surface of said lower one of said horizontal rails facing towards said panel, and the portion of said "V" defined by said second portion being adapted to engage a rearward edge of said lower one of said horizontal rails.

10. The assembly of claim 1 wherein each of said supports includes a grooved wheel mounted for rotation about an axis perpendicular to the plane of and fixed in position relative to said panel.

11. An advertising sign assembly comprising a plurality of panels adapted to be mounted on a generally vertical frame that includes at least two vertically-spaced elongated horizontal rails and to be positioned in edgewise abutment with each other to form a planar front advertising surface, each of said panels comprising:

a pair of horizontally-spaced supports attached to an upper portion of the back surface of said panel, each of said supports including a grooved wheel mounted for rotation about an axis perpendicular to the plane of and fixed in position relative to said panel, said wheel being adapted to engage the upper one of said horizontal rails when said panel is mounted on said frame;

at least one locking element track attached to the back surface of and extending generally vertically of said panel, said track including an elongated recess having a slot along the side thereof facing away from said panel;

at least one locking element slidably mounted on each said track, each said locking element including a first portion mounted within said recess and defining engagment surfaces extending generally longitudinally of said track and engaging longitudinally-extending portions of said track on opposite sides of said slot, and a second portion fixed relative to and extending rearwardly from said first portion through said slot, said second portion defining an inclined locking surface spaced rearwardly from said track and facing generally towards the back surface of said panel, said second portion being adapted to hook over and engage a lower one of said horizontal rails and draw said panel towards the front side of said rail when said panel is mounted on said frame and said locking element is slid relative to said track from a first position spaced from said lower one of said rails towards and into engagement with said lower one of said rails; and means for releasably securing said locking element in said first portion, said first position being above the point at which said locking element engages said lower one of said rails, and means including a block fixed relative to said track, and a clip attached to said locking element and adapted to releasably engage said block.

* * * * *